US007827944B2

(12) United States Patent
Pierik

(10) Patent No.: US 7,827,944 B2
(45) Date of Patent: Nov. 9, 2010

(54) SYSTEM FOR CONTROLLING THE RESPONSE TIME OF A HYDRAULIC SYSTEM

(75) Inventor: Ronald Jay Pierik, Holly, MI (US)

(73) Assignee: GM Global Technology Operations, Inc.

( * ) Notice: Subject to any disclaimer, the term of this patent is extended or adjusted under 35 U.S.C. 154(b) by 956 days.

(21) Appl. No.: 11/427,997

(22) Filed: Jun. 30, 2006

(65) Prior Publication Data

US 2008/0000438 A1 Jan. 3, 2008

(51) Int. Cl.
*F01L 9/02* (2006.01)

(52) U.S. Cl. ..... 123/90.12; 701/60

(58) Field of Classification Search ..... 123/90.12, 123/90.13, 90.15, 90.16, 90.17, 90.18; 701/60
See application file for complete search history.

(56) References Cited

U.S. PATENT DOCUMENTS 6,131,539 A * 10/2000 Thomas ..... 123/41.15
6,688,275 B2 * 2/2004 Shindou et al. ..... 123/198 F
6,712,651 B2 * 3/2004 Kanno ..... 440/1
7,375,105 B2 * 5/2008 Dean et al. ..... 514/231.5

* cited by examiner

*Primary Examiner*—Ching Chang

(57) ABSTRACT

A control system and method for a hydraulic system (HS) that controls a fluid supply in an engine includes a timer module determines the response time of the HS to perform at least one of: increasing the pressure of the fluid supply above a predetermined threshold following the state change command and decreasing said pressure of said fluid supply below said predetermined threshold following said state change command. An update module updates the desired time of the HS based on the response time of the HS.

11 Claims, 5 Drawing Sheets

SYSTEM FOR CONTROLLING THE RESPONSE TIME OF A HYDRAULIC SYSTEM

FIELD OF THE INVENTION

The present invention relates to internal combustion engines, and more particularly to a system for controlling the response time of a hydraulic system.

BACKGROUND OF THE INVENTION

Intake valves control entry of an air/fuel mixture into cylinders of an internal combustion engine. Exhaust valves control gases exiting the cylinders of an internal combustion engine. Camshaft lobes (or "cam lobes") on a camshaft push against the valves to open the valves as the camshaft rotates. Springs on the valves return the valves to a closed position. The timing, duration and degree of the opening, or "valve lift," of the valves can impact performance.

As the camshaft rotates, the cam lobes open and close the intake and exhaust valves in time with the motion of the piston. There is a direct relationship between the shape of the cam lobes and the way that the engine performs at different speeds and loads. When running at low speeds, the cam lobes should ideally be shaped to open the intake valve as the piston starts moving downward in the intake stroke. Generally, the intake valve should close as the piston reaches the bottom of its stroke and then the exhaust valve opens. The exhaust valve closes as the piston completes the exhaust stroke at the top of its stroke.

At higher engine speeds, however, this configuration for the cam lobes does not work as well. If, for example, the engine is running at 4,000 RPM, the valves are opening and closing 33 times every second. At this speed, the piston is moving very quickly. The air/fuel mixture rushing into the cylinder is also moving very quickly. When the intake valve opens and the piston starts the intake stroke, the air/fuel mixture in the intake runner starts to accelerate and move into the cylinder. By the time that the piston reaches the bottom of its intake stroke, the air/fuel mixture is moving at a high speed. If the intake valve is shut quickly, all of the air/fuel flow stops and does not enter the cylinder. By leaving the intake valve open longer, the momentum of the fast-moving air/fuel mixture continues flowing into the cylinder as the piston starts its compression stroke. The faster the engine turns, the faster the air/fuel mixture moves and the longer the intake valve should stay open. The valve should also be opened to a greater lift value at higher speeds and higher loads. This parameter, called "valve lift," is governed by the cam lobe profile. A fixed cam lobe profile which always lifts the valve the same amount does not work well at all engine speeds and loads. Fixed cam lobe profiles tend to compromise engine performance at both idle and at high loads.

Variable valve actuation (VVA) technology improves fuel economy, engine efficiency, and/or performance by modifying the valve event lift, timing, and duration as a function of engine operating conditions. Two-step VVA systems enable two discrete valve events on the intake and/or exhaust valves. The engine control module (ECM) selects the optimal valve event profile that is best utilized for each engine operating condition.

An issue in the development and application of the two-step VVA system is the response time variability of a Control Valve (CV) and VVA hydraulic control system. A limited amount of time is available for switching two-step Switching Roller Finger Followers (SRFF) between engaging in one valve event and the corresponding part of the next valve event of another engine cylinder controlled by the same CV. If the CV causes a fluid pressure change in the lifter fluid gallery to occur too soon relative to the critical part of a valve lift curve, the SRFF arm lock pin may only partially engage and then disengage after the valve has started lifting. This unscheduled disengagement is called a "Critical Shift" and may cause the engine valve to drop uncontrollably from the high-lift valve event to the low-lift valve event, or on to the valve seat. After a number of such events, the SRFF arm or the valve may show signs of accelerated wear or damage.

Several factors can affect hydraulic system variation including but not limited to engine oil aeration, duration of engine operation, wear upon the components of the engine, degradation of fluid quality over time, engine temperature, and/or fluid viscosity. These factors increase hydraulic system variations among engines and contribute to the accelerated wear and damage to the engine components.

SUMMARY OF THE INVENTION

A control system and method for a hydraulic system (HS) that controls a fluid supply in an engine includes a timer module determines a response time of the HS to perform at least one of: increasing a pressure of the fluid supply above a predetermined threshold following a state change command and decreasing the pressure of the fluid supply below the predetermined threshold following the state change command. An update module updates the desired time of the HS based on the response time of the HS.

In other features, a pressure sensor senses the pressure of the fluid supply. A control valve (CV) controls the fluid supply. A command module selectively generates and transmits the state change command to the CV when the engine requires a mode change and the engine is operating within a predetermined operating range.

In still other features, the timer module stores a first time when the command module transmits the state change command to the CV and stores a second time when a comparison module detects that the pressure of the fluid supply has at least one of: exceeded the predetermined threshold and fallen below said predetermined threshold. The response time of the HS is based on a difference between the first time and the second time In still other features the desired time of the HS is indexed in a look-up table that is a function of predetermined engine operating conditions. The update module updates the desired time to equal the response time when the response time exceeds a predetermined time range about the desired time for the predetermined operating condition. Engine operating condition is based on at least one of: engine speed, engine voltage, engine temperature, and fluid temperature.

A control system for controlling a hydraulic system (HS) in an engine includes a pressure sensor that senses pressure of a fluid supply. A control valve (CV) of the HS controls the fluid supply. A control module communicates with the pressure sensor. The control module selectively generates and transmits a state change command to the CV. The control module determines a response time of the HS to at least one of: increase the pressure of the fluid supply above a predetermined threshold following the state change command and decrease the pressure of the fluid supply below the predetermined threshold following the state change command. The control module updates a desired time of the HS based on the response time of the HS.

In other features, the control module selectively generates and transmits the state change command to the CV when the engine requires a mode change and the engine is operating within a predetermined operating range. The control module stores a first time upon generating said state change command and stores a second time upon detecting the pressure of the fluid supply has at least one of: exceeded a predetermined threshold and fallen below the predetermined threshold. The response time of the HS is based on a difference between the first time and the second time. The desired time of the HS is indexed in a look-up table that is a function of predetermined engine operating conditions.

In still other features the control module updates the desired time to equal the response time when the response time exceeds a predetermined time range of said desired time for said engine operating point. Engine operating points are based on at least one of: engine speed, engine voltage, engine temperature, and fluid temperature.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1:
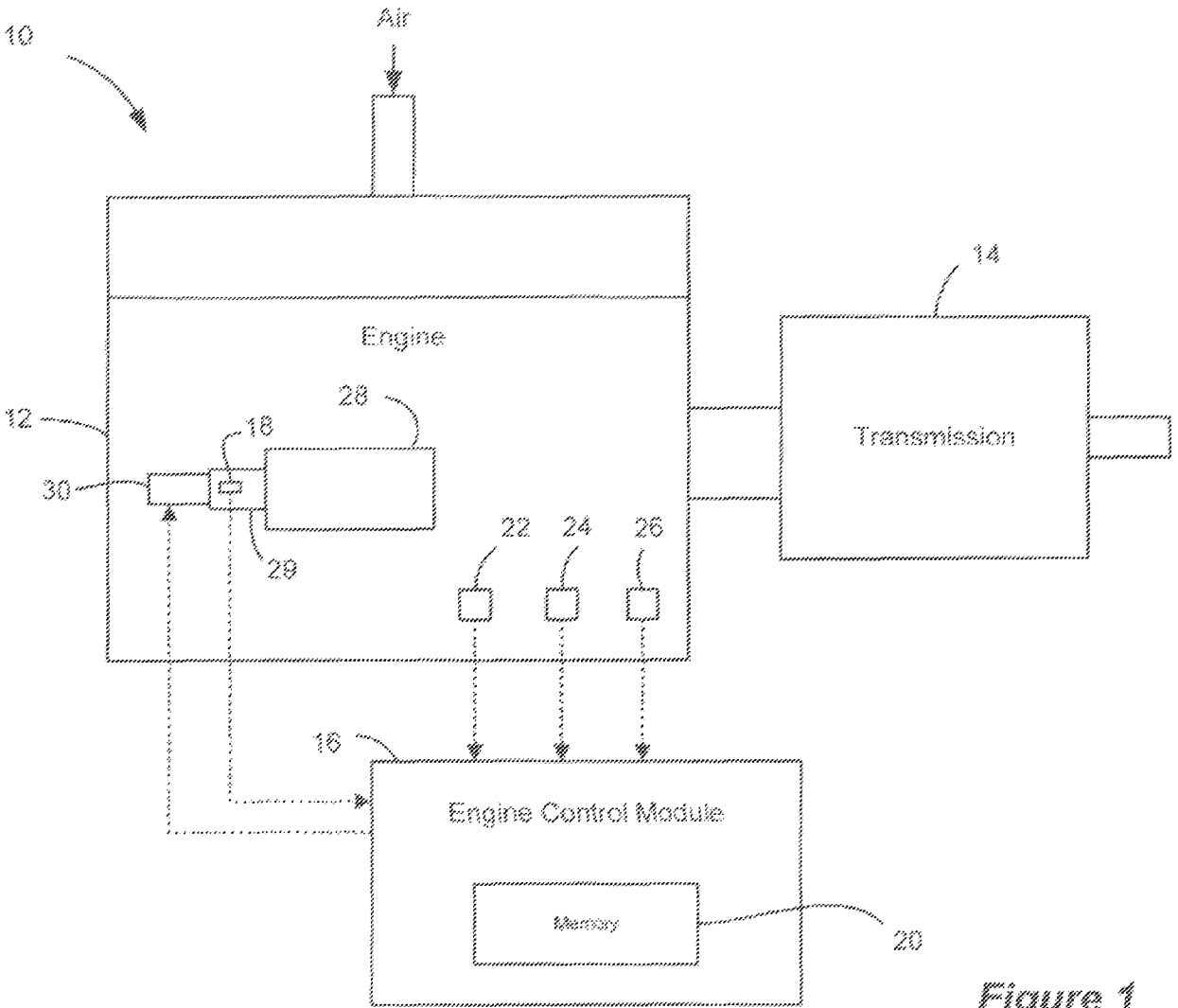
FIG. 1 illustrates an exemplary vehicle including an engine control module (ECM) that communicates with engine sensors and controls the control valve (CV) of a switching roller finger follower (SRFF) mechanism.

The following description of the preferred embodiment is merely exemplary in nature and is in no way intended to limit the invention, its application, or uses. For purposes of clarity, the same reference numbers will be used in the drawings to identify similar elements. As used herein, the term "module" refers to an application specific integrated circuit (ASIC), an electronic circuit, a processor (shared, dedicated, or group) and memory that execute one or more software or firmware programs, a combinational logic circuit, and/or other suitable components that provide the described functionality.

Figure 4:
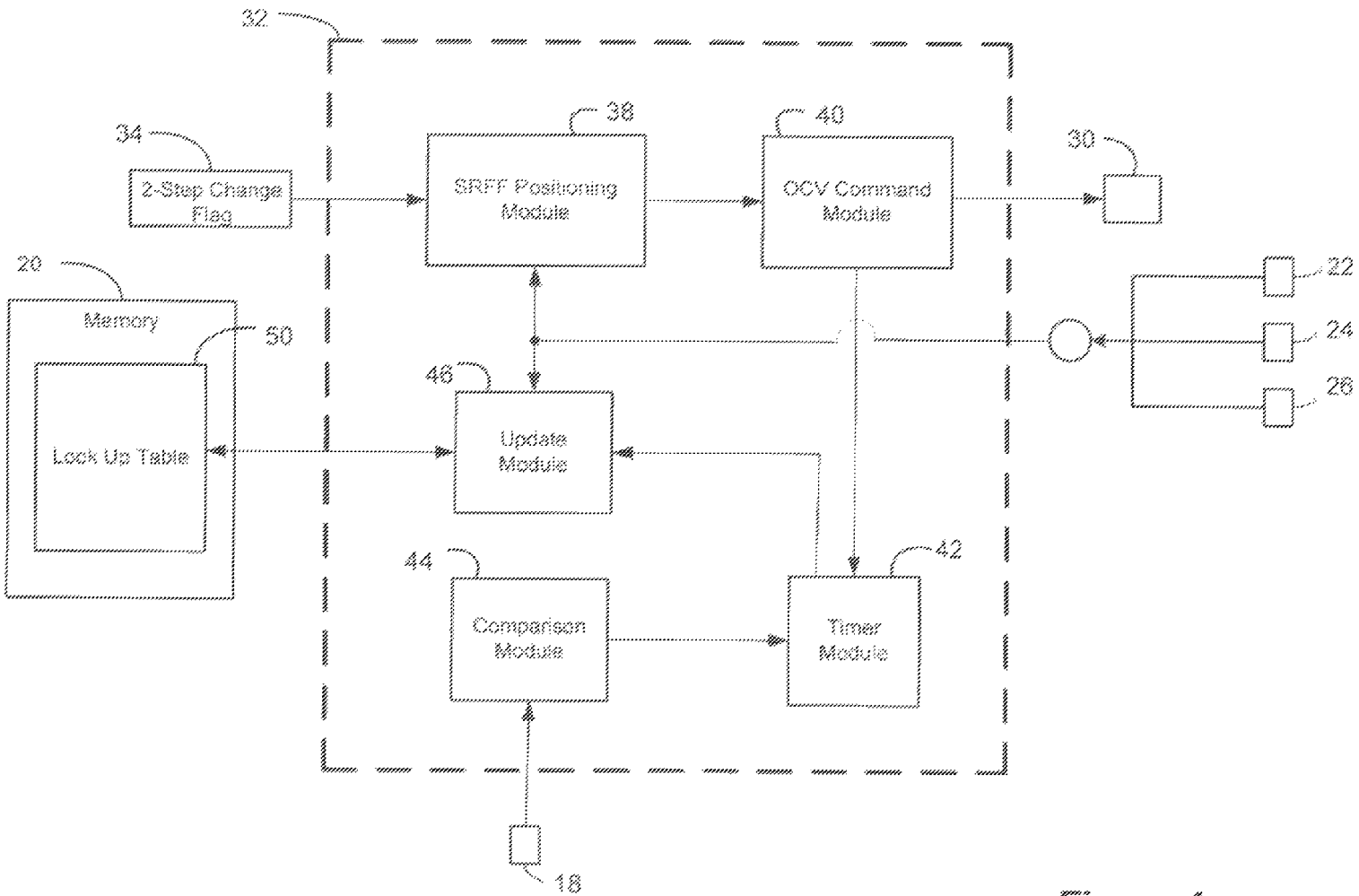
FIG. 4 is a functional block diagram of a control system for controlling the response time of a hydraulic system according to the present invention.

Referring to FIG. 1, an exemplary vehicle 10 includes an engine 12, a transmission 14, and an engine control module (ECM) 16. The operation of a two-step switching roller finger follower (SRFF) mechanism 28 is controlled by a control valve (CV) 30 that controls a fluid supply (not shown) to a hydraulic lash adjuster 29. The ECM 16 monitors the operation of the vehicle 10 using various engine sensors. The ECM 16 communicates with a fluid pressure sensor 18, an engine speed sensor 22, an engine voltage sensor 24, and an engine temperature sensor 26. The fluid pressure sensor 18 generates a signal indicating the fluid pressure within a hydraulic lash adjuster 29 fluid gallery (not shown), and the engine speed sensor 22 generates a signal indicating engine speed (RPM). In various embodiments, the fluid pressure sensor 18 can be positioned in other fixed engine fluid galleries including but not limited to a cam phaser gallery (not shown). The engine voltage sensor 24 generates a signal indicating the operating voltage of the engine electric system, and the engine temperature sensor 26 generates a signal indicating the operating temperature of the engine. The ECM 16 includes memory 20 that stores a look-up table 50, as depicted in FIG. 4, for utilization in commanding the CV 30 to switch the operating mode of the SRFF mechanism 28. In various embodiments, rather than switching among operating modes of the SRFF mechanism 28, specific operating modes of the SRFF 28 may be commanded to be deactivated from operation. Such embodiments are known in the art and include but are not limited to Valve Deactivation systems.

Figure 2:
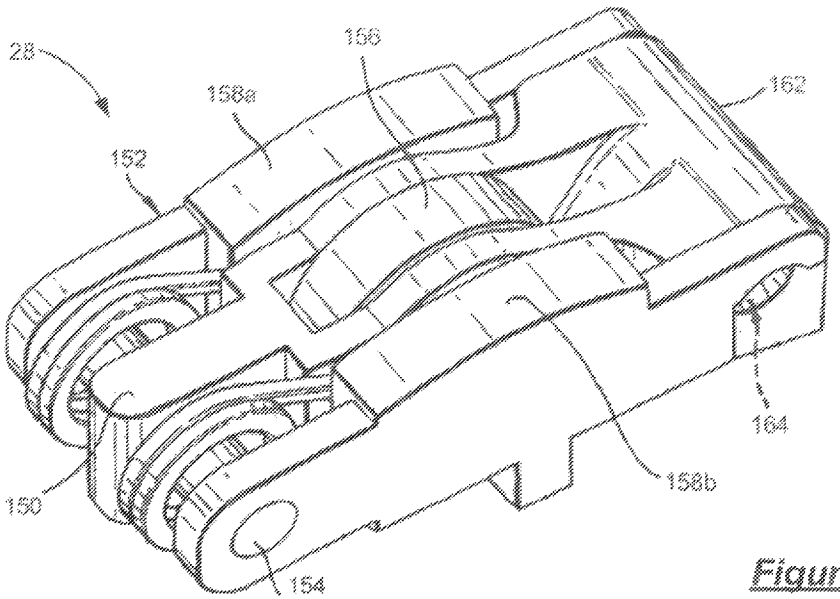
FIG. 2 is a three-dimensional view of the SRFF mechanism.
Figure 3:
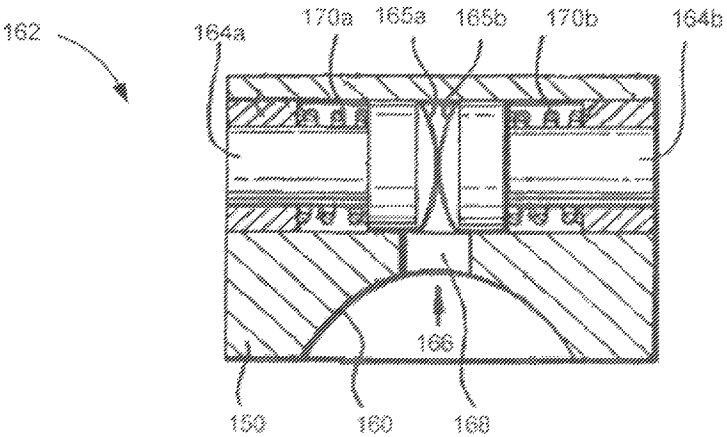
FIG. 3 is a cross-sectional view through the SRFF mechanism.

Referring now to FIGS. 2 and 3, a switching roller finger follower (SRFF) mechanism 28 is schematically depicted. It is appreciated that the SRFF mechanism 28 is merely exemplary in nature. The SRFF mechanism 28 includes an inner arm assembly 150 and an outer arm assembly 152 which are pivotably joined by a pivoting pin 154. The inner arm assembly 150 includes a low-lift contact 156 which interfaces with a low-lift cam lobe (not shown) of a camshaft (not shown). The outer arm assembly 152 includes a pair of high-lift contacts 158*a*, 158*b* as depicted in FIG. 2, that are configured for contact with a pair of high-lift cams lobes (not shown) of the camshaft and are positioned on either side of the low-lift contact 156. The inner arm assembly 150 defines a cavity 160 in which a portion of a hydraulic lash adjuster (not shown) can be inserted and about which the inner arm assembly 150 may also pivot.

As depicted in FIG. 3, a locking pin housing 162 contains locking pins 164*a*, 164*b*. The locking pins 164*a*, 164*b* restrict the independent movement of the outer arm assembly 152 from the inner arm assembly 150 about the pivoting pin 154 when the locking pins 164*a*, 164*b* are in an engaged position. The end faces 165*a*, 165*b* of locking pins 164*a*, 164*b*, respectively exist in fluid communication with a source of fluid pressure 166 such as a fluid supply (not shown). The fluid supply is fed from the hydraulic lash adjuster (not shown) to the locking pin housing 162 through a fluid supply hole 168.

The fluid supply from the hydraulic lash adjuster is controlled by a solenoid or CV, as depicted in FIG. 1 at 30. At predetermined engine operating ranges, the ECM, as depicted in FIG. 1 at 16, can cause the CV 30 to switch the fluid supply of the hydraulic lash adjuster from a lower pressure (P1) (not shown) to a higher pressure (P2) (not shown) within the locking pin housing 162. When fluid pressure (P2) is sufficiently high, the pressure exerted on the locking pins 164*a*, 164*b* is sufficient to overcome the resistance provided by the springs 170*a*, 170*b* resulting in the locking pins 164*a*, 164*b* being extended from their retracted position (shown) to an engaged position (not shown). While the locking pins 164*a*, 164*b* are in an engaged position, the outer arm assembly 152 is locked to the inner arm assembly 150 and causes the valve (not shown) to follow the high lift cam (not shown) that interfaces with the high-lift contacts 158*a*, 158*b*.

FIG. 3 depicts the SRFF mechanism 28 configured to operate in low-lift mode. In "normal" (fluid pressure supply at P1) operation, or "low-lift" mode, the low lift cam lobe causes the inner arm assembly 150 to pivot to a second position in accordance with the low-lift cam's prescribed geometry and thereby open a valve (not shown) a first predetermined amount. In various embodiments, a different low mode lift profile may exist for each of the adjacent valves in any given cylinder. The pressure inside the locking pin housing 162 is sufficiently low such that the locking pins 164*a*, 165*b* remain in the retracted position. The low pressure fluid supply (P1), which enters the inner arm assembly 150 at the cavity 160 and is fed through the hydraulic lash adjuster, is of insufficient pressure to compress the spring 170 and cause the locking pins 164*a*, 164*b* to engage in order to lock the inner arm assembly 150 for motion dependent on the outer arm assembly 152. In this condition, the valve (not shown) moves due to the low lift cam (not shown) interfacing with the low-lift contact on the inner arm (150).

In a high-lift mode (not shown), the ECM 16 instructs the CV 30 to increase the fluid pressure in the locking pin housing 162 to a higher pressure state (P2) sufficiently such that the locking pins 164*a*, 164*b* compress the springs 170*a*, 170*b*, respectively and is in an engaged position resulting in the outer arm assembly 152 being locked to the inner, low lift arm 150 and thus prevented to independently pivot about the pivoting pin 154. The outer arm assembly 152 pivots to a third position in accordance with the high-lift cam lobe geometry causing the valve to open to a second predetermined amount greater than the first predetermined amount. The present invention recognizes that in various embodiments, switching the fluid supply from P1 to P2 can cause the locking pins 164*a*, 164*b* to retract and therefore disengage the outer arm assembly 152 from the inner arm assembly 150 and prevent the valve (not shown) from following the high lift cam (not shown) that interfaces with the high-lift contacts 158.

Additionally, the present invention envisions further embodiments that may require maintaining a fluid supply at a pressure state of P2 in which P2 represents "normal" operation of the SRFF mechanism 28. In such embodiments, the ECM 16 instructs the CV 30 to decrease the fluid pressure in the locking pin housing 162 to a lower pressure state (P1) in order to engage or disengage the locking pins 164*a*, 164*b*. The present invention further envisions an embodiment having a single locking pin 164 serve to engage the outer arm assembly 152.

Referring now to FIG. 4, a hydraulic control system 32 includes monitoring and transmitting signals received from engine sensors including but not limited to the engine speed sensor 22, the engine voltage sensor 24, and the engine temperature sensor 26. A two-step change flag 34 indicates that the engine requires a change in the lift mode of the SRFF mechanism 28 to maintain appropriate engine operation. A SRFF positioning module 38 monitors the two-step change flag 34 and compares the measured engine operating speed, $RPM_{op}$, received from the engine speed sensor 22 to a predetermined RPM range. If the value of $RPM_{op}$ is within the predetermined RPM range and the two-step change flag 34 is set, the SRFF positioning module 38 enables the CV command module 40.

The command module 40 commands the CV 30 to change its state of operation by generating and transmitting a state change command to the CV 30. In accordance with the state change command, the CV 30 switches the fluid supply provided to the locking pin housing 162 via the hydraulic lash adjuster from a low pressure state (P1) to a higher pressure state (P2). When the command module 40 commands the CV 30 to change its state, a timer module 42 stores the clock time of this command as $T_a$. A comparison module 44 monitors the fluid pressure sensor 18 and compares the pressure within the fluid gallery of the hydraulic lash adjuster 29 to a predetermined pressure threshold. When the comparison module 44 detects a signal from the fluid pressure sensor 18 that the pressure exerted by the fluid supply within the fluid gallery of the hydraulic lash adjuster 29 has exceeded or fallen below a predetermined threshold, the timer module 42 stores this second clock time as $T_b$. The timer module 42 then calculates the time difference between $T_a$ and $T_b$ as the time response, $T_{act}$, of the CV 30 to the change of state command.

An update module 46 receives signals from the engine speed sensor 22, the engine voltage sensor 24, and the engine temperature sensor 26 indicating the engine operating condition. The update module 46 then retrieves a desired time, $T_{des}$, of the CV 30 from a lookup table 50 that corresponds to the engine operating condition sensed by the update module 46. The update module 46 compares the value of $T_{act}$ to $T_{des}$. If the value of $T_{act}$ has exceeded a predetermined time range about $T_{des}$, the update module 46 assigns a new value to $T_{des}$ by setting $T_{des}$ equal to $T_{act}$ and stores the new value $T_{des}$ in the look-up table 50 as a function of the engine operating condition.

Figure 5A:
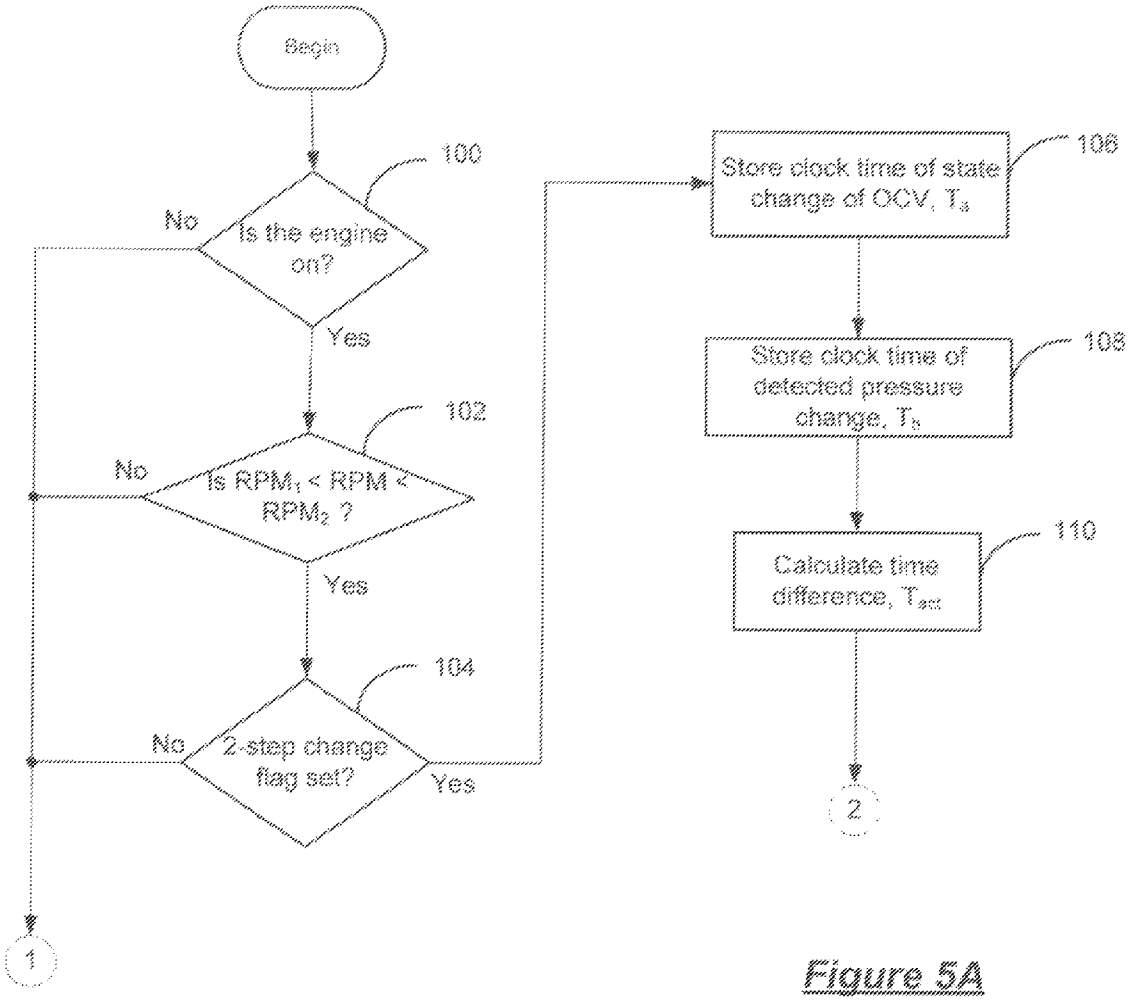
FIG. 5 is a flow chart illustrating the exemplary steps executed by a control system for controlling the response time of a hydraulic system according to the present invention.
Figure 5B:
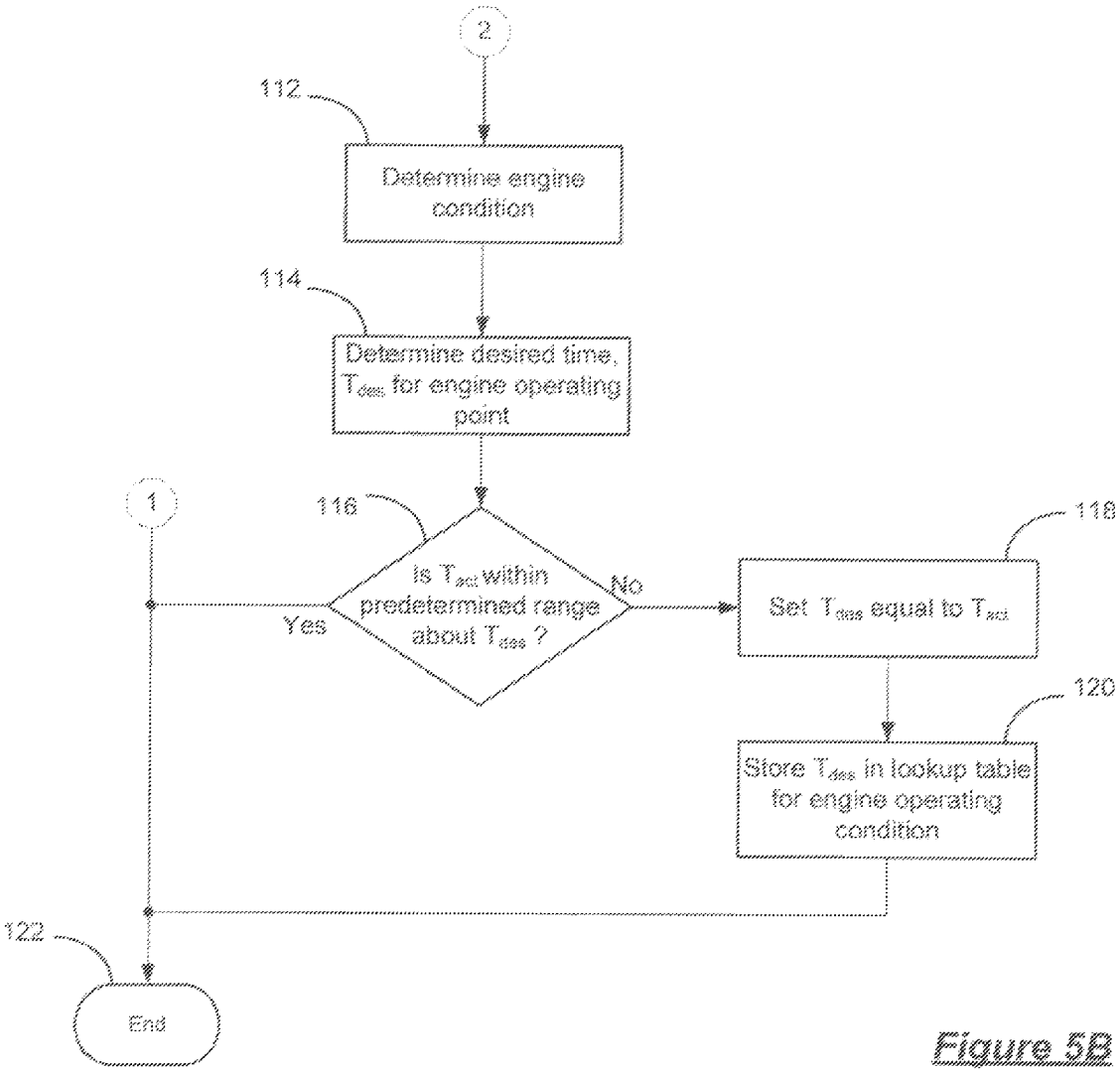

Referring now to FIG. 5, the hydraulic control system 32 will be described in further detail. In step 100, if the engine 12 is turned on, the ECM 16 will be operational and proceed to step 102. If the engine is not turned on, the ECM 16 will not be operational and the hydraulic control system 32 will not be initiated. In step 102, the SRFF positioning module 38 determines whether the engine is operating within a predetermined RPM range. The predetermined RPM range is an engine and mechanism specific range. If the engine operating speed, $RPM_{op}$, is not within the predetermined RPM range, the process ends.

If the $RPM_{op}$ is within the predetermined RPM range, the SRFF positioning module 38, in step 104, determines whether a two-step change flag 34 is set indicating that the engine requires a change in the lift mode of SRFF mechanism 28. If a position change of the SRFF mechanism 28 is not required and the two-step change flag 34 is not set, the process ends. If the two-step change flag 34 is set, the SRFF positioning module 38 enables the command module 40. In step 106, the command module 40 generates and transmits a state change command directing the CV 30 to change its state of operation by switching the fluid supply provided to the locking pin housing 162 from either a low pressure state (P1) to a higher pressure state (P2) or from P2 to P1. Additionally in step 106, the timer module 42 stores the time of the sate change command as a first time, $T_a$.

In step 108, when the comparison module 44 detects that the pressure exerted by the change in fluid supply has either exceeded or fallen below a predetermined pressure threshold within the locking pin housing 162, the timer module 42 stores the corresponding time as a second time, $T_b$. In step 110, the timer module 42 calculates the time difference between $T_a$ and $T_b$ as $T_{act}$. The response time of the hydraulic control system 32 is based on $T_{act}$. In step 112, the update module 46 determines the engine operating condition by monitoring the engine speed sensor 22, the engine voltage sensor 24, and the engine temperature sensor 26.

In step 114, the update module 46 retrieves a desired time of the hydraulic control system 32, $T_{des}$, from a look-up table 50 that corresponds to engine operating condition in step 112. In step 116, the update module 46 compares the value $T_{act}$ to $T_{des}$. If the update module 46 determines that $T_{act}$ is within a predetermined time range, about $T_{des}$, the process ends. If the update module 46 determines that $T_{act}$ has exceeded the predetermined time range about $T_{des}$, the update module 46 assigns a new value to $T_{des}$ by setting $T_{des}$ equal to $T_{act}$ in step 118. In step 120, the look-up table 50 stores the value $T_{des}$ as a function of the engine operating point read in step 112. The process ends in step 122. Important to note is that the applicability of the present invention is not limited to embodiments that employ SRFF technology but is additionally applicable to valve train technologies that utilize a CV to control the activation of a hydraulic system to regulate valve events. Such valve train technologies include but are not limited to Displacement on Demand technologies and other related VVA technologies.

Additionally, the scope of the invention is not limited to embodiments that solely implement engine component or system control valves. The current invention is applicable to various systems that employ valve control operations including but not limited to transmission torque converters, clutches and brakes.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, the specification and the following claims.

What is claimed is:

1. A control system for a hydraulic system (HS) that controls a fluid supply in an engine, comprising:

a timer module that determines a response time of said HS to perform at least one of: increasing a pressure of said fluid supply above a predetermined threshold following a state change command and decreasing said pressure of said fluid supply below said predetermined threshold following said state change command;

an update module that updates a desired time of said HS based on said response time of said HS;

a pressure sensor that senses said pressure of said fluid supply;

a control valve (CV) of said HS that controls said fluid supply; and a command module that selectively generates and transmits said state change command to said CV when said engine requires a mode change and said engine is operating within a predetermined operating range, wherein said timer module stores a first time when said command module transmits said state change command to said CV and stores a second time when a comparison module detects that said pressure of said fluid supply has at least one of: exceeded said predetermined threshold and fallen below said predetermined threshold, wherein said response time of said HS is based on a difference between said first time and said second time.

2. The control system of claim 1 wherein said desired time of said HS is indexed in a look-up table that is a function of predetermined engine operating conditions.

3. The control system of claim 2 wherein said update module updates said desired time to equal said response time when said response time exceeds a predetermined time range about said desired time for said predetermined engine operating condition.

4. The control system of claim 3 wherein said engine operating condition is based on at least one of: engine speed, engine voltage, engine temperature, and fluid temperature.

5. A method of controlling a hydraulic system (HS) that controls a fluid supply in an engine comprising:

determining a response time of said HS to perform at least one of: increasing a pressure of said fluid supply above a predetermined threshold following a state change command and decreasing said pressure of said fluid supply below said predetermined threshold following said state change command;

updating a desired time of said HS based on said response time of said HS;

sensing pressure of said fluid supply;

selectively generating and transmitting said state change command to a control valve (CV) of said HS when said engine requires a mode change and said engine is operating within a predetermined operating range;

storing a first time when said state change command is transmitted to said CV; and storing a second time when said pressure of said fluid supply has at least one of: exceeded a predetermined threshold and fallen below said predetermined threshold, wherein said response time of said HS is based on a difference between said first time and said second time.

6. The method of claim 5 wherein said desired time of said HS is indexed in a look-up table that is a function of predetermined engine operating conditions and wherein said desired time is updated to equal said response time when said response time exceeds a predetermined time range about said desired time for said predetermined engine operating condition.

7. The method of claim 6 wherein said engine operating condition is based on at least one of: engine speed, engine voltage, and engine temperature, and fluid temperature.

8. A control system for controlling a hydraulic system (HS) in an engine comprising:

a pressure sensor that senses pressure exerted by a fluid supply;

a control valve (CV) of said HS that controls said fluid supply; and a control module that communicates with said pressure sensor, that selectively generates and transmits a state change command to said CV, that determines a response time of said HS to at least one of: increase said pressure of said fluid supply above a predetermined threshold following said state change command and decrease said pressure of said fluid below said predetermined threshold following said state change command, and that updates a desired time of said HS based on said response time of said HS, wherein said control module selectively generates and transmits said state change command to said CV when said engine requires a mode change and said engine is operating within a predetermined operating range, and wherein said control module stores a first time upon transmitting said state change command to said CV and stores a second time upon detecting that said pressure of said fluid supply has at least one of: exceeded a predetermined threshold and fallen below said predetermined threshold, wherein said response time of said HS is based on a difference between said first time and said second time.

9. The control system of claim 8 wherein said desired time of said HS is indexed in a lookup table that is a function of predetermined engine operating conditions.

10. The control system of claim 9 wherein said control module updates said desired time to equal said response time when said response time exceeds a predetermined time range about said desired time for said engine operating condition.

11. The control system of claim 10 wherein said engine operating condition is based on at least one of engine speed, engine voltage, engine temperature, and fluid temperature.

* * * * *